US008284011B2

(12) United States Patent
Hofsaess

(10) Patent No.: US 8,284,011 B2
(45) Date of Patent: Oct. 9, 2012

(54) CAP FOR A TEMPERATURE-DEPENDENT SWITCH

(76) Inventor: Marcel P. Hofsaess, Pforzheim (DE)

( * ) Notice: Subject to any disclaimer, the term of this patent is extended or adjusted under 35 U.S.C. 154(b) by 189 days.

(21) Appl. No.: 12/817,563

(22) Filed: Jun. 17, 2010

(65) Prior Publication Data

US 2011/0006873 A1 Jan. 13, 2011

(30) Foreign Application Priority Data

Jun. 22, 2009 (DE) ..... 10 2009 030 353

(51) Int. Cl.
*H01H 37/04* (2006.01)
*H01H 37/02* (2006.01)

(52) U.S. Cl. ..... 337/381; 337/380; 337/298; 337/97; 337/112; 337/113; 29/622

(58) Field of Classification Search ..... 337/97, 337/112, 113, 298, 380, 381; 29/622
See application file for complete search history.

(56) References Cited

U.S. PATENT DOCUMENTS

| | | | | | |
|---|---|---|---|---|---|
| 2,707,738 | A | * | 5/1955 | Weissheimer et al. | 337/368 |
| 2,907,851 | A | * | 10/1959 | Moorhead et al. | 337/377 |
| 3,414,225 | A | * | 12/1968 | Lester | 248/506 |
| 4,027,385 | A | * | 6/1977 | Deubel | 29/622 |
| 4,297,668 | A | * | 10/1981 | Place | 337/365 |
| 4,446,450 | A | * | 5/1984 | Boulanger et al. | 337/380 |
| 4,446,451 | A | * | 5/1984 | Boulanger | 337/380 |
| 4,467,385 | A | * | 8/1984 | Bandoli et al. | 361/24 |
| 4,626,821 | A | * | 12/1986 | Versaw | 337/380 |
| 4,641,121 | A | * | 2/1987 | Boulanger | 337/380 |
| 4,887,063 | A | * | 12/1989 | Hofsass | 337/380 |
| 5,011,101 | A | * | 4/1991 | Buchser | 248/27.3 |
| 5,126,510 | A | * | 6/1992 | Bauer et al. | 174/547 |
| 5,307,543 | A | * | 5/1994 | Krillenberger | 24/543 |
| D365,804 | S | * | 1/1996 | Klaus | D13/178 |
| 5,670,930 | A | * | 9/1997 | Hofsass et al. | 337/380 |
| 5,699,033 | A | * | 12/1997 | Hofsass | 337/380 |
| 5,723,922 | A | * | 3/1998 | Fowlkes | 310/68 C |
| 5,745,022 | A | * | 4/1998 | Becher et al. | 337/104 |
| 5,828,285 | A | * | 10/1998 | Hofsass | 337/112 |
| 5,828,286 | A | * | 10/1998 | Hofsass | 337/343 |
| 5,864,279 | A | * | 1/1999 | Becher et al. | 337/380 |
| 5,877,671 | A | * | 3/1999 | Hofsass | 337/343 |
| 5,892,429 | A | * | 4/1999 | Hofsass | 337/377 |
| 5,903,418 | A | * | 5/1999 | Boivin et al. | 361/22 |
| 5,942,967 | A | * | 8/1999 | Grimes | 337/380 |
| 5,973,587 | A | * | 10/1999 | Hofsass | 337/377 |

(Continued)

FOREIGN PATENT DOCUMENTS

DE 2 121 802 1/1973

(Continued)

*Primary Examiner* — Anatoly Vortman
(74) *Attorney, Agent, or Firm* — Harness, Dickey & Pierce, P.L.C.

(57) ABSTRACT

A cap (27) for a temperature-dependent switch (10) having a first connection area (22) and at least one second connection area (23) on the outer surface of its housing (11, 12) for the purpose of electrically connecting leads (25, 26) is designed as a cup-like surrounding housing that can be pushed onto the switch (10), preferably with an accurate fit, such that the connection areas (22, 23) for electrical connection are accessible from the outside after said surrounding housing has been pushed on, whereby a first opening (28) for the first connection area (22) and a second opening (29) for the second connection area (23) are provided in said cap (27).

17 Claims, 3 Drawing Sheets

U.S. PATENT DOCUMENTS

| | | | | |
|---|---|---|---|---|
| 6,031,447 | A * | 2/2000 | Hofsass | 337/377 |
| 6,064,295 | A * | 5/2000 | Becher et al. | 337/349 |
| 6,091,316 | A * | 7/2000 | Hofsass | 337/377 |
| 6,097,274 | A * | 8/2000 | Hofsass | 337/362 |
| 6,100,784 | A * | 8/2000 | Hofsass | 337/343 |
| 6,115,916 | A | 9/2000 | Hofsäss | |
| 6,133,817 | A * | 10/2000 | Hofsass et al. | 337/377 |
| 6,154,117 | A * | 11/2000 | Sato et al. | 337/365 |
| 6,181,233 | B1 * | 1/2001 | Hofsass et al. | 337/377 |
| 6,191,680 | B1 * | 2/2001 | Hofsass | 337/362 |
| 6,249,210 | B1 * | 6/2001 | Hofsass | 337/324 |
| 6,249,211 | B1 * | 6/2001 | Hofsaess | 337/377 |
| 6,300,860 | B1 * | 10/2001 | Hofsass | 337/377 |
| 6,302,361 | B1 * | 10/2001 | Schaefer et al. | 248/27.3 |
| D450,045 | S * | 11/2001 | Yang | D13/184 |
| 6,417,758 | B1 * | 7/2002 | Russell et al. | 337/380 |
| 6,448,883 | B1 * | 9/2002 | Hofsass | 337/373 |
| 6,507,267 | B2 * | 1/2003 | Russell et al. | 337/380 |
| 6,583,710 | B2 * | 6/2003 | Hayashi et al. | 337/343 |
| 6,724,293 | B1 * | 4/2004 | Hofsass | 337/365 |
| 6,781,504 | B2 * | 8/2004 | Scott et al. | 337/380 |
| 7,345,571 | B2 * | 3/2008 | Mizuno | 337/381 |
| 7,622,835 | B2 * | 11/2009 | Kimball et al. | 310/68 C |
| 7,626,484 | B2 * | 12/2009 | Scott et al. | 337/343 |
| 7,663,467 | B2 * | 2/2010 | Hsu | 337/336 |
| 7,839,259 | B2 * | 11/2010 | Takeda et al. | 337/380 |
| 2002/0055298 | A1 | 5/2002 | Becher et al. | |

FOREIGN PATENT DOCUMENTS

| | | | |
|---|---|---|---|
| DE | 24 42 397 | A1 | 3/1976 |
| DE | 26 44 411 | A1 | 4/1978 |
| DE | 3733693 | A1 * | 5/1988 |
| DE | 91 02 841.8 | | 5/1992 |
| DE | 92 14 543.4 | | 2/1993 |
| DE | 195 07 488 | A1 | 9/1996 |
| DE | 195 45 996 | A1 | 9/1996 |
| DE | 196 23 421 | A1 | 12/1997 |
| DE | 196 23 570 | A1 | 1/1998 |
| DE | 197 05 153 | A1 | 8/1998 |
| DE | 197 05 411 | A1 | 8/1998 |
| DE | 197 54 158 | A1 | 5/1999 |
| DE | 103 01 803 | A1 | 7/2004 |
| DE | 10 2005 001 371 | A1 | 7/2006 |
| EP | 0 859 391 | A2 | 8/1998 |
| FR | 2 444 549 | | 7/1980 |
| GB | 1 394 612 | | 5/1975 |
| JP | 4-101317 | | 4/1992 |

* cited by examiner

CAP FOR A TEMPERATURE-DEPENDENT SWITCH

FIELD OF THE INVENTION

The present invention relates to a cap for a temperature-dependent switch comprising a first connection area and at least one second connection area on the outer surface of its housing for the purpose of electrically connecting leads, as well as to a temperature-dependent switch provided with such a cap and to a method for producing such a temperature-dependent switch.

BACKGROUND OF THE INVENTION

DE 24 42 397 A1 discloses such a cap for a temperature-dependent switch, which cap is designed as a cup-shaped surrounding housing which can be pushed from below with fit onto the switch such that strands welded to the upper part of the switch housing lead out of the cap. The upper opening of the cap is thereafter closed by a resin covering.

Such temperature-dependent switches are widely known from the prior art. They are used to protect electrical devices, for example hairdryers, motors of lye pumps, irons etc., from overheating and/or an excessively high current.

For this purpose, the known temperature-dependent switches are electrically connected in series with the device to be protected in the supply circuit of the latter, with the result that the operating current of the device to be protected flows through the temperature-dependent switch. The switch is also fitted to the device to be protected in such a manner that it assumes the temperature of the device to be protected, for which purpose the switch is ideally provided with a heat transfer area which lies on the electrical device to be protected.

The known temperature-dependent switches comprise a temperature-dependent switching mechanism which, on the basis of its temperature, opens or closes an electrical connection between two connection areas provided on the outer surface of the housing of the switch. For this purpose, a bimetal part is generally provided in the switching mechanism, which part, upon reaching its switching temperature, is abruptly deformed from its low-temperature position into its high-temperature position and in the process generally lifts a movable contact part off a fixed contact part.

The fixed contact part is connected to one of the two connection areas, whereas the movable contact part is connected to the second connection area either via the bimetal part or via a snap-action disk or spring assigned to the bimetal part.

Designs in which the bimetal part carries a contact bridge which directly establishes an electrical connection between two connection areas are also known.

Examples of such temperature-dependent switches are described in DE 21 21 802 A, DE 26 44 411 A, DE 196 23 570, DE 103 01 803 and further intellectual property rights of this applicant, reference being made to these intellectual property rights regarding further details of the design of such temperature dependent switches.

In addition to the thermal coupling of the known switches, it is also necessary to ensure that the switches are electrically insulated from the electrical device to be protected so that undesirable short circuits do not occur.

This is because the known switches often have an electrically conductive housing lower part which is in the form of a pot and accommodates the temperature-dependent switching mechanism. The electrically conductive housing lower part is closed by a cover part which is likewise electrically conductive and is fixed to the housing lower part with the interposition of an insulating film. The first connection area is provided on the cover part, whereas the second connection area is provided on the base, the side wall or the rim of the housing lower part which holds the cover part.

Leads, generally either flexible connection strands or rigid connection lugs, are now electrically connected, generally soldered or welded, to these two connection areas, the strands or connection lugs then being used to further connect the known temperature-dependent switches.

The prefabricated switches provided with strands or connection lugs in this manner are then provided with a cap in order to electrically insulate the switches with respect to the outside. If the switches are provided with connection lugs, the caps have corresponding slots through which the connection lugs have to be threaded when pushing the cap onto the switch, which is not only correspondingly time-consuming and arduous but also always entails the risk of the electrical connection between the connection lugs and the connection areas being damaged or the connection lugs bending, with the result that they are not suitable for subsequent automatic installation in electrical devices to be protected but rather have to be reworked.

In contrast, if the leads are in the form of strands, the switches are provided with so-called shrink-fitted caps which are closed at one end, with the result that, after the shrink-fitted caps have been pushed onto the switches prefabricated with the strands, the strands at the other end project from the shrink-fitted cap. The shrink-fitted caps are then shrunk onto the switch.

One example of such a shrink-fitted cap is shown in DE 197 05 153 A1, DE 197 54 158 A1 showing a method for closing such a shrink-fitted cap after the switch with soldered strands has been inserted.

Switches which are provided with a cap or an insertion or surrounding housing are disclosed, for example, in DE 92 14 543 U, DE 91 02 841 U, DE 197 05 441 A1, DE 195 45 996 A1 or DE 10 205 001 371 A1.

All of these known caps for temperature-dependent switches have the disadvantage that the caps or surrounding housings either have a very complicated design or else the mounting of the cap on the switch which has already been provided with connection lugs is complicated and cannot be automated.

SUMMARY OF THE INVENTION

In view of the above, one object of the present invention is to provide a cap of the type mentioned at the outset which makes it possible to fit the switch with the cap in an automatable and reliable manner and enables a simple method for electrically connecting the leads.

In the case of the cap mentioned at the outset, this and other objects are achieved, according to the invention, in that the cap is designed as a cup-like surrounding housing that can be pushed onto the switch, preferably with an accurate fit, such that that the connection areas for electrical connection are accessible from the outside after said surrounding housing has been pushed on, whereby a first opening for the first connection area and a second opening for the second connection area are provided in the surrounding housing, the cap preferably comprising a base and a side wall which adjoins the base, surrounds the base and delimits an insertion opening for the switch opposite the base, the first opening further preferably being formed in the base and the second opening being at least partially formed in the side wall.

The objects underlying the invention are completely achieved in this manner.

This is because the inventor of the present application has recognized that, contrary to the previous practice in the prior art, it is nevertheless possible to first of all provide a temperature-dependent switch with a cap, that is to say a surrounding housing, and only then to electrically connect the leads to the connection areas of the switch.

Technologies which can be used to very cleanly solder or weld strands or connection lugs to connection areas without damaging the cap material which surrounds the connection areas are available for this purpose. For example, a hot drop of solder can be provided by a soldering iron for this purpose, which drop is accurately dropped onto the connection area.

A method for making it possible to provide a temperature-dependent switch, as disclosed in DE 21 21 802 A, with strands is described in DE 196 23 421 A1, for example. According to the described method, strands are soldered to a metal housing of a temperature-dependent switch with the aid of a soldering template.

Similar methods can now also be used to solder or weld strands or connection lugs to a switch which has already been provided with the cap according to the invention.

The measures according to the invention have the advantage, on the one hand, that the connection areas can be arranged far enough away from one another, with the result that the soldering operations do not hinder one another, and, on the other hand, that existing temperature-dependent switches can be used, as disclosed, for example, in DE 21 21 802 A, DE 26 44 411 A or DE 196 23 570 A1 mentioned at the outset.

For this purpose, the temperature-dependent switch is inserted into the surrounding housing which, on account of the design with an accurate fit, automatically latches onto the housing of the switch or lies on said housing in a captive manner, the connection areas and the openings being oriented with respect to one another as early as during this insertion operation.

In a next step, the strands or connection lugs are then soldered or welded to the connection areas, soldering being preferred. However, it is also possible to use conductive adhesives.

In this case, the base of the switch projects from the cap, with the result that this base can be used, as a heat contact area or heat transfer area, to bring the switch into thermal contact with the electrical device to be protected.

According to one object, the first and second openings are connected to one another, and the soldering operation is particularly simple since the recesses in the cap allow access to the connection areas without the cap material being damaged by the soldering operation.

In this case, the cap is preferably produced from an electrically insulating, temperature-resistant material, for example from polyimides, which are sold, for example, under the name Kapton® by DuPont, or from aromatic polyamides which are sold, for example, under the name Nomex® or Kevlar® by DuPont.

In view of the above, the present invention also relates to a temperature-dependent switch comprising a first connection area and at least one second connection area on the outer surface of its housing for the purpose of electrically connecting leads as well as a temperature-dependent switching mechanism within the housing, which mechanism establishes or opens an electrically conductive connection between the two connection areas on the basis of its temperature, the switch being provided with the novel cap.

In this case, a lead is soldered to each of the connection areas, which leads may be in the form of strands or connection lugs. In this case, the strands are generally flexible, whereas the connection lugs are rather rigid.

According to another object, the switch has a heat transfer area on its housing, which area projects out of the cap.

The invention also relates to a method for producing a temperature-dependent switch, comprising the steps of:

a) providing a temperature-dependent switch comprising a first connection area and at least one second connection area on the outer surface of its housing for the purpose of electrically connecting leads as well as a temperature-dependent switching mechanism within the housing, which mechanism establishes or opens an electrically conductive connection between the two connection areas on the basis of its temperature,
b) providing the novel cap,
c) pushing the cap onto the switch, with the result that the connection areas are accessible from the outside, and
d) electrically connecting leads to the connection areas.

In this case, it is preferred if strands or connection lugs are soldered on in step d).

According to a further object, in step d), the connection lugs are punched out from a strip, the switches which have been provided with the cap are then supplied and the connection areas of said switches are soldered to the respective connection lugs which are still on the strip.

This measure has the advantage that it is possible to produce not only the temperature-dependent switches and the caps, but the switches which have been fully provided with leads and are protected by the caps, in a fully automated manner.

If the connection lugs on the strip are punched out, that is to say are punched out from an endless sheet-metal strip, the height of the free ends of the lugs may still have to be bent so that the lugs "match" the connection areas on the switch, the heights of which connection areas are offset with respect to one another. The switches provided with the caps are then supplied on a separate strip and are oriented with respect to the connection lugs which are still on the strip in such a manner that the lugs come to lie on the connection areas where they are then automatically soldered.

Further advantages follow from the description and the attached drawings.

It goes without saying that the features mentioned above and the features still to be explained below can be used not only in the respective combinations stated but also in other combinations or alone without departing from the scope of the present invention.

BRIEF DESCRIPTION OF THE DRAWINGS

One embodiment of the invention is explained in more detail in the following description and is illustrated in the drawings, in which:

FIG. 4 shows a plan view of connection lug pairs which have been punched out from a strip but are still on the strip, temperature-dependent switches which have already been provided with caps having been soldered on.

DESCRIPTION OF A PREFERRED EMBODIMENT

Figure 1:
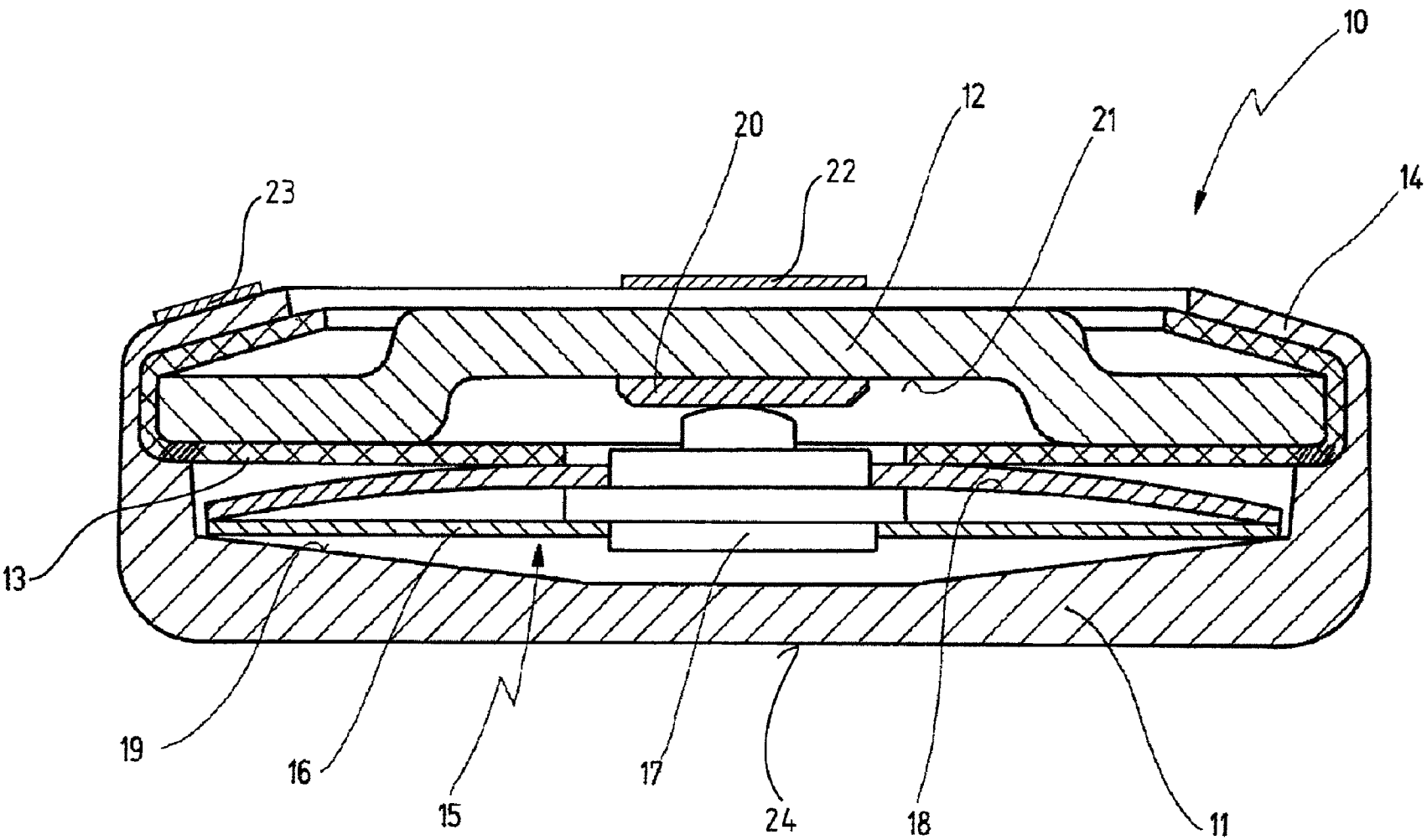
FIG. 1 shows a diagrammatic, sectioned cross-sectional illustration of a temperature-dependent switch.

In FIG. 1, 10 is used to denote a temperature-dependent switch comprising a pot-like lower part 11 which is closed by a cover part 12 which is held on the housing lower part 11 by a flanged rim 14 with the interposition of an insulating film 13.

A temperature-dependent switching mechanism 15 is arranged within the housing of the switch 10, which housing formed by the lower part 11 and the cover part 12, said mechanism comprising a spring snap-action disk 16 which centrally carries a movable contact part 17 on which a freely inserted bimetal disk 18 is arranged.

The spring snap-action disk 16 is supported on a base 19 inside the lower part 11 which is produced from electrically conductive material.

The movable contact part 17 is in contact with a fixed contact part 20 provided on an inner side 21 of the cover part 12 which is likewise produced from metal.

In this manner, the temperature-dependent switching mechanism 15 establishes an electrically conductive connection between the cover part 12 and the lower part 11 in the low-temperature position shown in FIG. 1, the operating current flowing via the fixed contact part 20, the movable contact part 17 and the spring snap-action disk 18.

If the temperature of the bimetal disk 18 increases above its response temperature, said disk snaps from the convex position shown in FIG. 1 into its convex position in which it lifts the movable contact part 17 off the fixed contact part 20 against the force of the spring disk 16 and thus opens the circuit.

Such a temperature-dependent switch 10 is disclosed, for example, in DE 196 23 570 A1, the contents of which are hereby incorporated by reference in the subject matter of the present disclosure.

In the switch from FIG. 1, a central region of the cover part 12, on the one hand, and a region on the flanged rim 14, on the other hand, are used as connection areas 22 and 23, respectively.

Either a connection strand or a connection lug is now respectively soldered to these connection areas 22, 23, as described further below.

So that the switch 10 can be thermally coupled to an electrical device to be protected, the switch has a planar base which is in the form of a heat transfer area 24 and comes into contact with the electrical device to be protected.

As already mentioned, the lower part 11 and cover part 12 of the switch 10 from FIG. 1 are made of electrically conductive material, with the result that the switch must be insulated with respect to the outside before being installed in an electrical device to be protected, for which purpose a cap is used, as now described in connection with FIG. 2.

Figure 2:
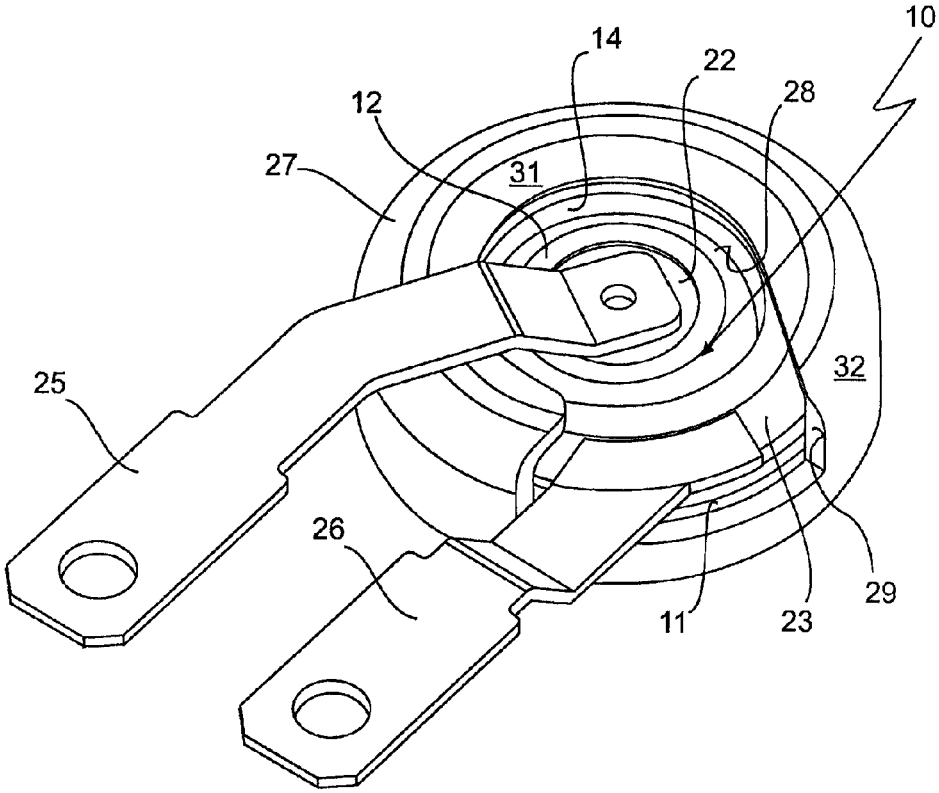
FIG. 2 shows a perspective view, obliquely from above, of a temperature-dependent switch with a cap which has been pushed on and connection lugs which have been soldered on, FIG. 3 shows an illustration like FIG. 2 but in a view obliquely from below.

FIG. 2 shows a perspective illustration, obliquely from above, of the switch 10 from FIG. 1, a connection lug 25 and 26 having been soldered to each of the two connection areas 22 and 23.

However, before soldering on the connection lugs 25 and 26, a cap 27 was pushed onto the switch 10, which cap has a first opening 28 for electrically connecting the first connection lug 25 and a second opening 29 for electrically connecting the second connection lug 26.

It can be seen in the perspective view obliquely from below in FIG. 3 that the heat transfer area 24 of the switch 10 projects from the cap 27 at the bottom, with the result that the switch is electrically insulated laterally and toward the top, on the one hand, but can be thermally coupled in an effective manner toward the bottom to an electrical device to be protected, on the other hand.

The cap 27 is in the form of a cup-like surrounding housing 30 which can be pushed onto the switch 10 with an accurate fit, with the result that said housing is held there in a captive manner.

In this connection, the cap 27 has a base 31 and a side wall 32 which adjoins the base 31, surrounds the base 31 and delimits an insertion opening 33 for the switch 10 opposite the base 31. The base of the switch 10 in FIG. 2, that is so to say the heat transfer area 24, projects from this insertion opening 33. The cap 27 thus sits on the switch 10 in a captive manner and with an accurate fit.

The first opening 28 is centrally formed in the base 31 and the second opening 29 is formed partially in the side wall 32 and partially in the base 31. The two openings 28 and 29 are connected to one another, with the result that they form a corresponding recess in the cap 27.

The openings 28, 29 thus uncover the connection areas 22, 23 to the outside such that they are accessible for soldering operations without damaging the surrounding cap 27.

Furthermore, cap 27 is produced from an electrically insulating, temperature-resistant material, for example from Kapton® or Nomex®, which is not damaged by the generation of heat during the soldering operation.

Figure 3:
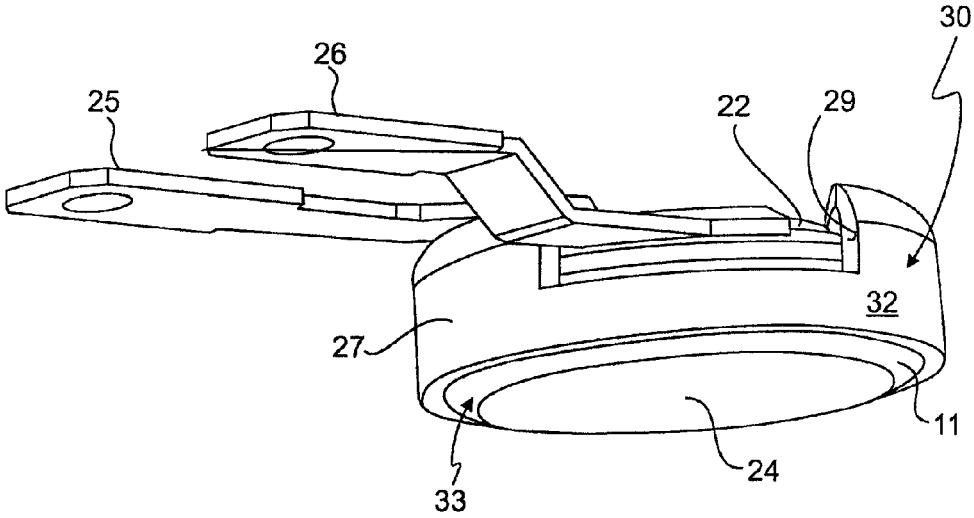
Figure 4:
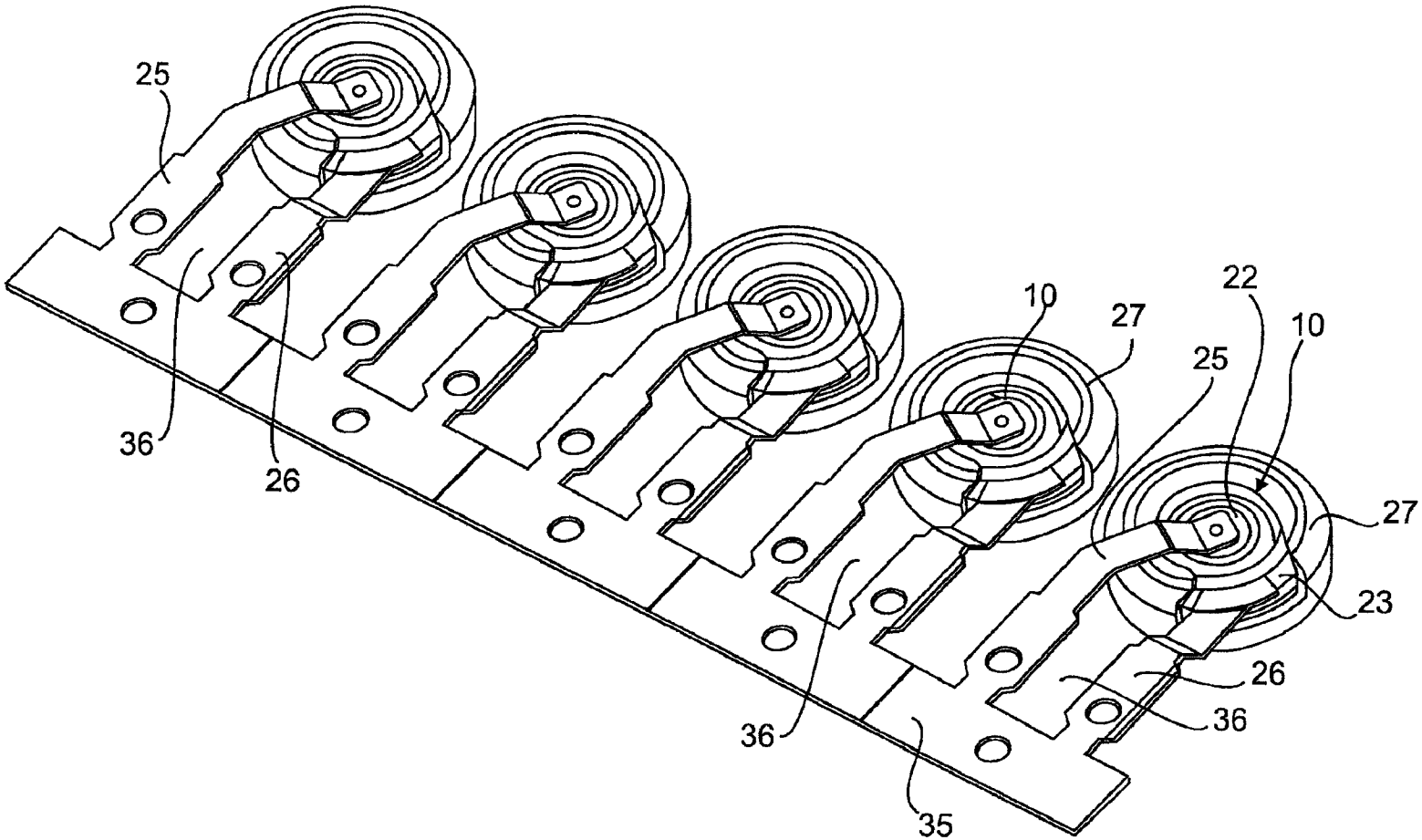

FIG. 4 shows a method for producing the switch from FIGS. 2 and 3, pairs 36 of connection lugs 25, 26 having been punched out on a strip 35 there, one end of which lugs is still connected to the strip but the other end of which has already been soldered to temperature-dependent switches 10 which were previously provided with the cap 27, however.

During the strip production of the temperature-dependent switches, the connection lugs 25, 26 are thus first of all punched out in pairs and the free ends of said lugs are then bent such that the lugs match the connection areas 22, 23 of the temperature-dependent switches 10. These switches 10 are first of all provided with a cap 27 and are then supplied to the strip such that the connection lugs 25, 26 can be soldered to the connection areas 22, 23.

Therefore, what is claimed is:

1. A cap for a temperature-dependent switch, said switch comprising a switch housing having an outer surface, a first connection area and at least one second connection area being arranged on said outer surface of said switch housing, said connection areas provided for external connection of said switch and designed for electrically connecting to leads, said cap being designed as a cup-like surrounding housing to be pushed onto the switch such that the connection areas are accessible from outside the cap after said cap has been pushed onto the switch, said cup-like surrounding housing of said cap having a first opening portion for providing access from outside to the first connection area and a second opening portion for providing access from outside to the second connection area, wherein said first opening portion and said second opening portion are connected to one another to enable the leads to be welded or soldered to said first and second connection areas after said cap has been pushed onto said switch housing.

2. The cap of claim 1, which is designed such that it sits on said switch housing with an accurate fit in a captive manner when pushed onto the switch.

3. The cap of claim 1, wherein the cap comprises a base and a side wall, which side wall adjoins the base, surrounds the base and defines an insertion opening for the switch opposite the base.

4. The cap of claim 3, wherein the first opening portion is formed in the base and the second opening portion is at least partially formed in the side wall.

5. The cap of claim 1, wherein the cap is produced from an electrically insulating, temperature-resistant material.

6. The cap of claim 5, wherein the material comprises polyimides and/or aromatic polyamides.

7. A temperature-dependent switch comprising:

a housing having an outer surface, a first connection area and at least one second connection area being arranged on said outer surface of said housing, said connection areas provided for external connection of said switch and designed for electrically connecting to leads, a temperature-dependent switching mechanism being arranged within the housing, which switching mechanism establishes or opens an electrically conductive connection between the two connection areas on the basis of its temperature, and a cap as claimed in claim 1.

8. The temperature-dependent switch of claim 7, wherein a lead is soldered to each of the connection areas.

9. The temperature-dependent switch of claim 8, wherein the leads comprise strands.

10. The temperature-dependent switch of claim 8, wherein the leads comprise connection lugs.

11. The temperature-dependent switch of claim 7, further comprising a heat transfer area on its housing, which area projects from the cap.

12. The temperature-dependent switch of claim 7, wherein the cap comprises a base and a side wall, which side wall adjoins the base, surrounds the base and defines an insertion opening for the switch opposite the base.

13. The temperature-dependent switch of claim 12, wherein the first opening is formed in the base and the second opening is at least partially formed in the side wall.

14. The cap of claim 1, wherein the cap comprises an external electrically insulating, temperature-resistant housing for the temperature-dependent switch.

15. The temperature-dependent switch of claim 7, wherein the cap comprises an external electrically insulating, temperature-resistant housing.

16. A method for producing a temperature-dependent switch having a housing with an outer surface, comprising the steps of:

a) providing a temperature-dependent switch comprising a housing, a temperature-dependent switching mechanism within the housing, and a first connection area and at least one second connection area on the outer surface of the housing for the purpose of electrically connecting leads, b), designed as a cup-like surrounding housing having an opening therein with a first portion providing access from outside the surrounding housing to the first connection area and a second portion providing access from outside the surrounding housing to the second connection area, c) pushing the cap onto the switch, with the result that the connection areas are accessible from the outside, and d) thereafter electrically connecting leads to the connection areas by welding or soldering.

17. The method of claim 16, wherein, in the step of electrically connecting leads to the connector areas, connection lugs are punched out on a strip, switches which have been provided with the cap are then supplied and the connection areas of said switches are soldered to the respective connection lugs which are still on the strip.

* * * * *

UNITED STATES PATENT AND TRADEMARK OFFICE

CERTIFICATE OF CORRECTION

PATENT NO. : 8,284,011 B2
APPLICATION NO. : 12/817563
DATED : October 9, 2012
INVENTOR(S) : Marcel P. Hofsaess It is certified that error appears in the above-identified patent and that said Letters Patent is hereby corrected as shown below:

Column 8,
Line 19 (Claim 16), before ",", insert -- providing a cap --.

Signed and Sealed this
Twenty-fifth Day of December, 2012

David J. Kappos

David J. Kappos
*Director of the United States Patent and Trademark Office*